US008875902B2

(12) United States Patent
Maile et al.

(10) Patent No.: US 8,875,902 B2
(45) Date of Patent: Nov. 4, 2014

(54) FASTENER SORTING DEVICE AND PROCESSING THEREOF

(75) Inventors: Dave Maile, Guelph (CA); Binh P. Tran, Scarborough (CA); Sebastian R. Lawrynowicz, Hamilton (CA); Doug Hyland, Kitchener (CA)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 416 days.

(21) Appl. No.: 13/115,389

(22) Filed: May 25, 2011

(65) Prior Publication Data

US 2012/0298565 A1 Nov. 29, 2012

(51) Int. Cl.
*B07C 5/12* (2006.01)
*B07B 1/14* (2006.01)

(52) U.S. Cl.
CPC . *B07B 1/145* (2013.01); *B07B 1/14* (2013.01); *Y10S 209/925* (2013.01); *Y10S 209/929* (2013.01)
USPC ..... 209/673; 209/925; 209/929

(58) Field of Classification Search
USPC ..... 209/660, 662, 667, 673, 691, 695, 696, 209/929
See application file for complete search history.

(56) References Cited

U.S. PATENT DOCUMENTS

| | | | | |
|---|---|---|---|---|
| 2,354,419 | A * | 7/1944 | Lingerfelt et al. | 209/630 |
| 2,374,948 | A | 5/1945 | Niederer et al. | |
| 3,220,548 | A * | 11/1965 | Flodin | 209/670 |
| 4,341,311 | A | 7/1982 | Gold et al. | |
| 4,557,125 | A * | 12/1985 | Schaumburg | 72/18.6 |
| 4,610,322 | A * | 9/1986 | Sugioka et al. | 177/25.18 |
| 6,787,724 | B2 * | 9/2004 | Bennett et al. | 209/586 |
| 2005/0242004 | A1 | 11/2005 | Lanni | |

* cited by examiner

*Primary Examiner* — Joseph C Rodriguez
*Assistant Examiner* — Kalyanavenkateshware Kumar
(74) *Attorney, Agent, or Firm* — Gifford, Krass, Sprinkle, Anderson & Citkowski, P.C.

(57) ABSTRACT

A machine for sorting fasteners that have a shaft with a head attached thereto from fasteners that only have a shaft. The machine can have a plurality of rollers that are rotatably attached to a frame, the plurality of rollers having a gap between each other and generally aligned parallel to each other. In addition, the plurality of rollers can be oriented at an angle relative to horizontal. The gap between each roller is dimensioned such that the shaft of a fastener can fit or fall therethrough and yet prevent the head of the fastener to fit or fall therethrough. The plurality of rollers can have an elevated end and an exit end, the exit end having an opening proximate thereto and dimensioned for the head of the fastener to fit therethrough.

15 Claims, 4 Drawing Sheets

FASTENER SORTING DEVICE AND PROCESSING THEREOF

FIELD OF THE INVENTION

The present invention relates to a machine and a process for sorting fasteners and, in particular, to a machine and a process for sorting fasteners that have a shaft with a head from fasteners that only have a shaft.

BACKGROUND OF THE INVENTION

The use of fasteners such as rivets is a common manufacturing and industrial practice for joining at least two components together. A rivet is typically known as a permanent mechanical fastener that has a generally smooth cylindrical shaft, also known as a shank, with a head on one end. A blind rivet, also known as a pop rivet, typically has a tubular head with a mandrel in the form of a shaft through the center thereof. Such a rivet is typically inserted into a hole that has been drilled through the components to be joined and a rivet tool is used to draw the mandrel into and thereby expand the head. In addition, the mandrel snaps off and falls away from the expanded head.

During the use of pop rivets, it is not uncommon for unused rivets having a shaft with a head to become mixed with used rivets that simply have a shaft. In addition, sorting of the used rivets from the unused rivets by hand can be a time-consuming job. In the alternative, throwing away unused rivets results in undesired waste. As such, a rivet sorting device or machine and a process thereof that can sort fasteners that have a shaft and a head from fasteners that only have a shaft would be desirable.

SUMMARY OF THE INVENTION

A machine for sorting fasteners that have a shaft with a head attached thereto from fasteners that only have a shaft is provided. The machine can have a plurality of rollers that are rotatably attached to a frame, the plurality of rollers having a gap between each other and generally aligned parallel to each other. The gap between each roller is dimensioned such that the shaft of a fastener can fit or fall therethrough and yet prevent the head of the fastener to fit or fall therethrough. In addition, the plurality of rollers can be oriented lengthwise at an angle relative to horizontal and thus have an elevated end and an exit end. In some instances, the machine can include an opening proximate the exit end of the rollers, the opening dimensioned for the head of the fastener to fit or fall therethrough.

The plurality of rollers can afford for sorting a plurality of fasteners by placing the fasteners onto the rollers proximate the elevated end and rotating the rollers, rotation of the rollers affording the fasteners to move from the elevated end towards the exit end. The gap between, and rotation of, the rollers also affords for the fasteners having only a shaft to fall between the rollers before reaching the exit end, and the fasteners having a shaft with a head not falling between the rollers, reaching the opening and falling therethrough. In some instances, a motor can be included and engaged with the plurality of rollers, the motor operable to rotate the plurality of rollers in a clockwise direction, a counterclockwise direction, and combinations thereof.

The fastener sorting machine can include a hopper that is located above the plurality of rollers and dimensioned for a plurality of fasteners to be placed therewithin. It is appreciated that the hopper can direct the plurality of fasteners to the plurality of rollers. In addition, the hopper can have at least one divider that can divide the plurality of fasteners between or among the plurality of rollers. The fastener sorting machine can also have a bin located below the plurality of rollers and used for collecting the fasteners that only have a shaft and fall between the rollers and for collecting the fasteners that have a shaft with a head and fall through the opening that is proximate the exit end of the rollers.

A process for sorting fasteners includes providing a fastener sorting machine as described above and providing a mixture of fasteners that have a shaft and a head and fasteners that have only a shaft. Thereafter, the mixture of fasteners is placed onto the plurality of rollers proximate the elevated end and the rollers are rotated. While the rollers are rotated, the mixture of fasteners moves down the rollers from proximate the elevated end towards the exit end with fasteners having only a shaft falling through the gap between the rollers before reaching the exit end. In contrast, the fasteners having a shaft with a head reach and fall through the opening proximate the exit end. It is appreciated that the head prevents such fasteners from falling through the gaps between the rollers.

DETAILED DESCRIPTION OF THE PRESENT INVENTION

The present invention provides a machine and a process for sorting mechanical fasteners that have a shaft with a head from fasteners that simply have a shaft. As such, the present invention has utility as a machine for sorting fasteners.

The fastener sorting machine can include a plurality of rollers that are aligned along a generally single plane relative to each other, have a gap in between each other, and are inclined lengthwise at an angle relative to horizontal. The gap between each of the rollers is dimensioned such that a shaft of a fastener to be sorted can fit and fall therethrough. However, the gap is also dimensioned such that a head of a fastener to be sorted cannot fall therethrough.

The plurality of rollers have an elevated end which is naturally higher than an opposing exit end, and when the rollers are rotated, fasteners that are placed onto the rollers proximate the elevated end move in a direction towards the exit end. In addition, fasteners that have only a shaft, and do not have a head, fall through the rollers before reaching the exit end. Proximate to the exit end can be an opening dimensioned such that the head of the fastener can fall therethrough. As such, as the fasteners that have a shaft with a head reach the opening, such fasteners fall through the opening at a desired location. In this manner, fasteners that only have a shaft fall between the rollers at a desired location and fasteners that have a shaft with a head fall from the rollers at a different and desired location.

A hopper can be used to supply the fasteners to a region proximate to the elevated end of the rollers and the hopper may or may not have one or more dividers that aid in separating or dividing the fasteners among the gaps and/or plurality of rollers.

Figure 1:
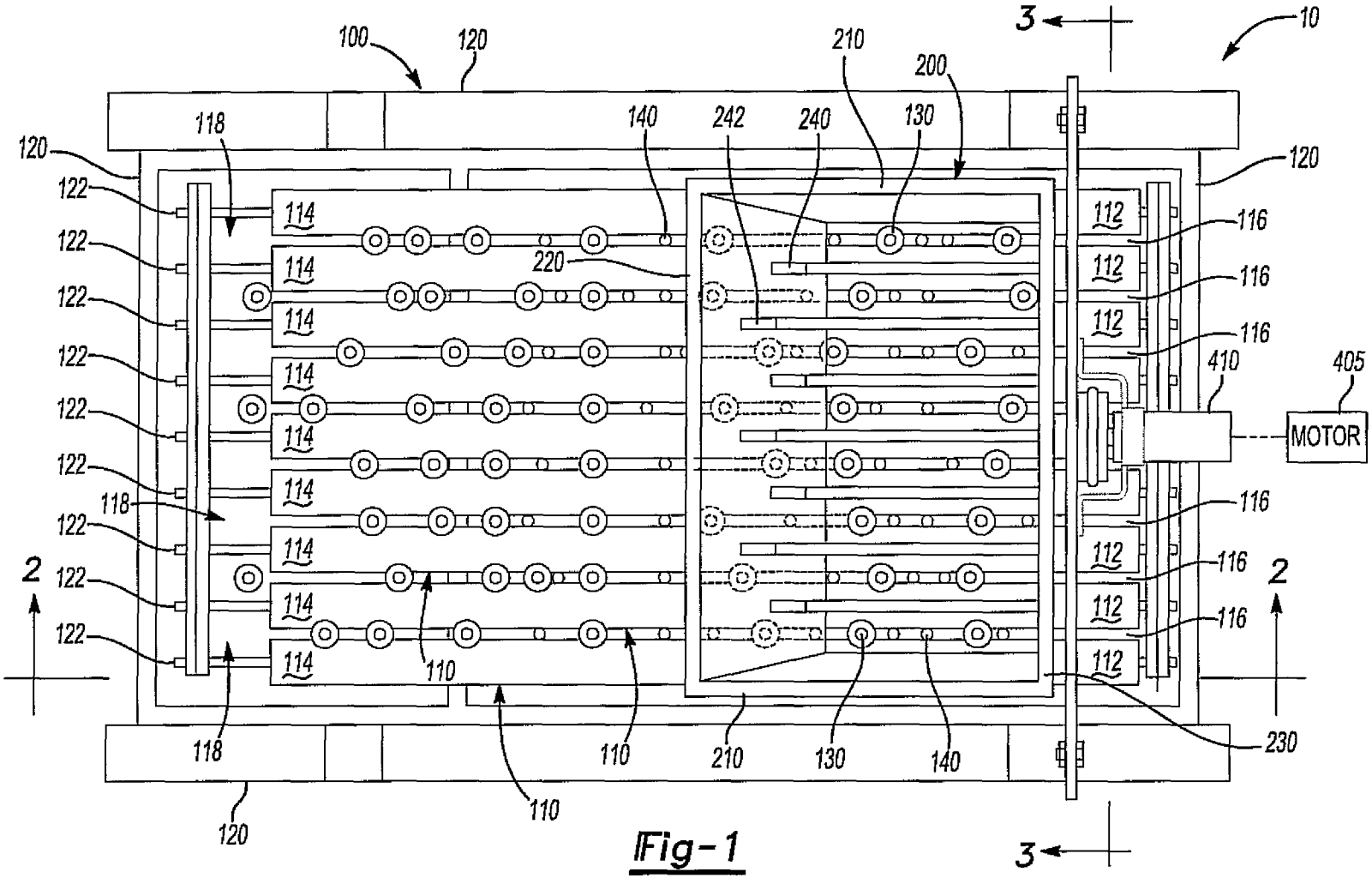
FIG. 1 is a top view of a fastener sorting machine according to an embodiment of the present invention.
Figure 2:
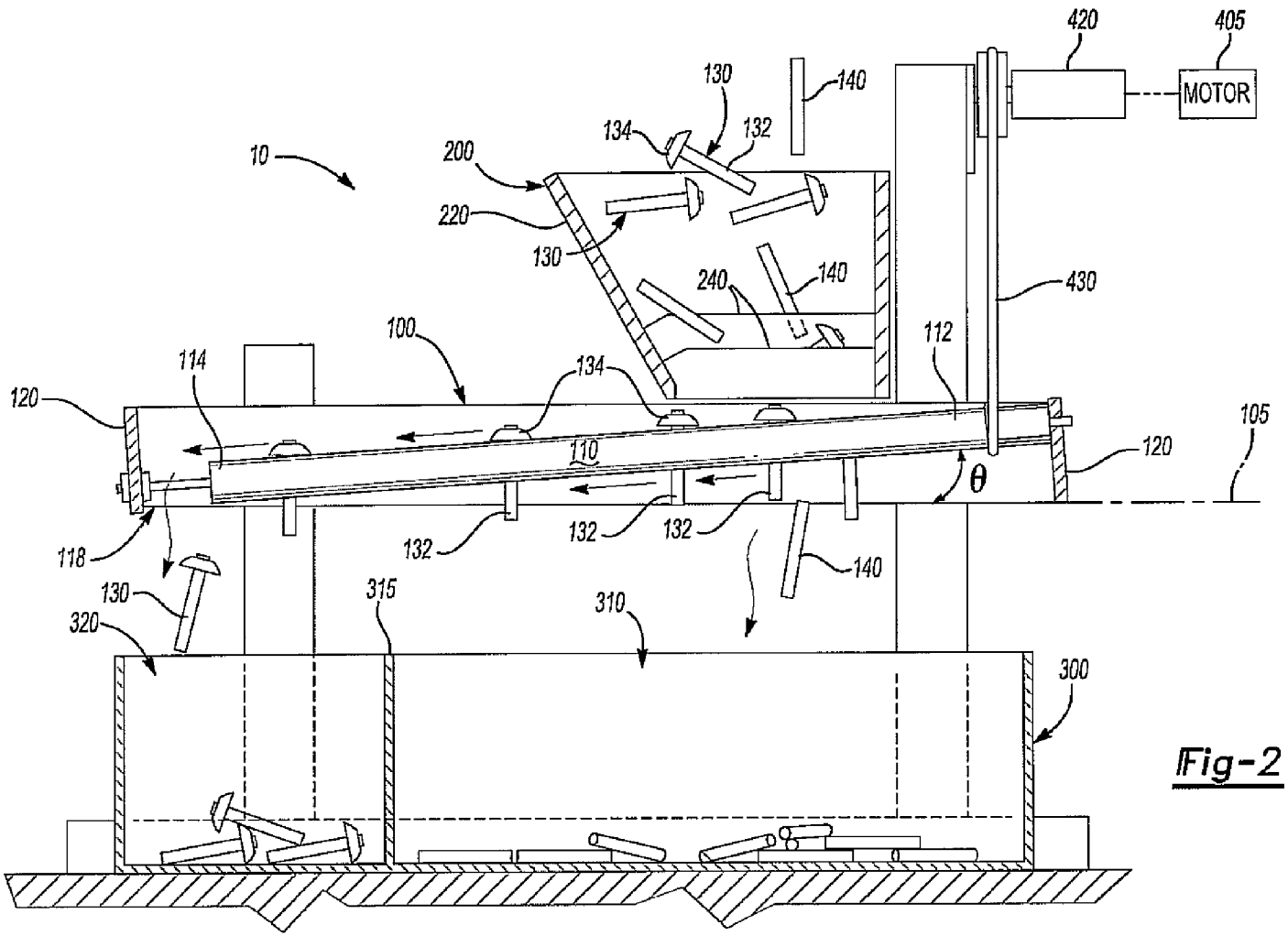
FIG. 2 is a side view of section 2-2 shown in FIG. 1.

Turning now to FIGS. 1 and 2, a top view and a side view, respectively, of a fastener sorting machine according to an embodiment of the present invention is shown generally at reference numeral 10. The fastener sorting machine 10 can include a fastener sorter 100, a hopper 200, and a bin 300. The fastener sorter 100 can have of a plurality of rollers 110 that are rotatably attached to a frame 120, for example through the use of a plurality of shafts 122. The shafts 122 may or may not include bearings, and the rollers 110, with or with or without bearings can rotate and turn as is known to those skilled in the art.

The plurality of rollers 110 can be generally parallel to each other as shown in FIG. 1 with a gap 116 between adjacent rollers. The rollers 110 can also have an elevated end 112 and an exit end 114, the elevated end 112 being higher than the exit end 114 as shown in FIG. 2. Stated differently, the rollers 110 can be at an angle theta (θ) relative to a horizontal plane or line 105. As such, gravity can assist in moving one or more fasteners from the elevated end 112 to the exit end 114.

For example and for illustrative purposes only, a plurality of fasteners 130 having a shaft 132 with a head 134 attached thereto and a plurality of fasteners 140 that simply have a shaft 142 can be placed onto the plurality of rollers 110 proximate to the elevated end 112. Upon rotation of the rollers 110, and with the aid of gravity, the fasteners arranged themselves such that the shaft 132 of fastener 130 and the shaft 142 of the fastener 140 fit and are located between adjacent rollers 110. In addition, fasteners 140 having only a shaft 142 fall between the rollers 110 through the gap 116 while the head 134 of the fastener 130 prevents the fastener 130 from falling between the rollers 110. With the rollers inclined at an angle θ from horizontal, and in combination with rotation of the rollers 110, the fasteners 130 move in a direction towards the exit end 114. Proximate to the exit end 114 can be an opening 118 that is dimensioned such that the head 134 can fit therethrough. As such, upon reaching the opening 118, the fastener 130 can fall from the rollers, for example into the bin 300.

Although the opening 118 is shown as a gap between the exit end 114 of the rollers 110 and the frame 120, the opening 118 can be any opening that is dimensioned such that the head 134 of the fastener 130 can fit and fall therethrough. For example, the rollers 110 themselves can be shaped such that at a desired location proximate to the exit end 114 the opening 118 is present and the fasteners 130 can fall therethrough.

The hopper 200 can be located proximate to the elevated end 112 of the plurality of rollers and have a pair of side walls 210, a first end wall 220, and a second end wall 230. The side walls 210 can be inclined towards the rollers 110, as can be the first end wall 220, such that fasteners placed or poured into the hopper 200 are directed towards the rollers 110. In addition, one or more dividers 240 and/or 242 can be included with the hopper 200, the dividers 240 and 242 having different lengths and heights such that desired separation or division of the plurality of fasteners between the rollers 110 and thus gaps 116 is provided.

Figure 3:
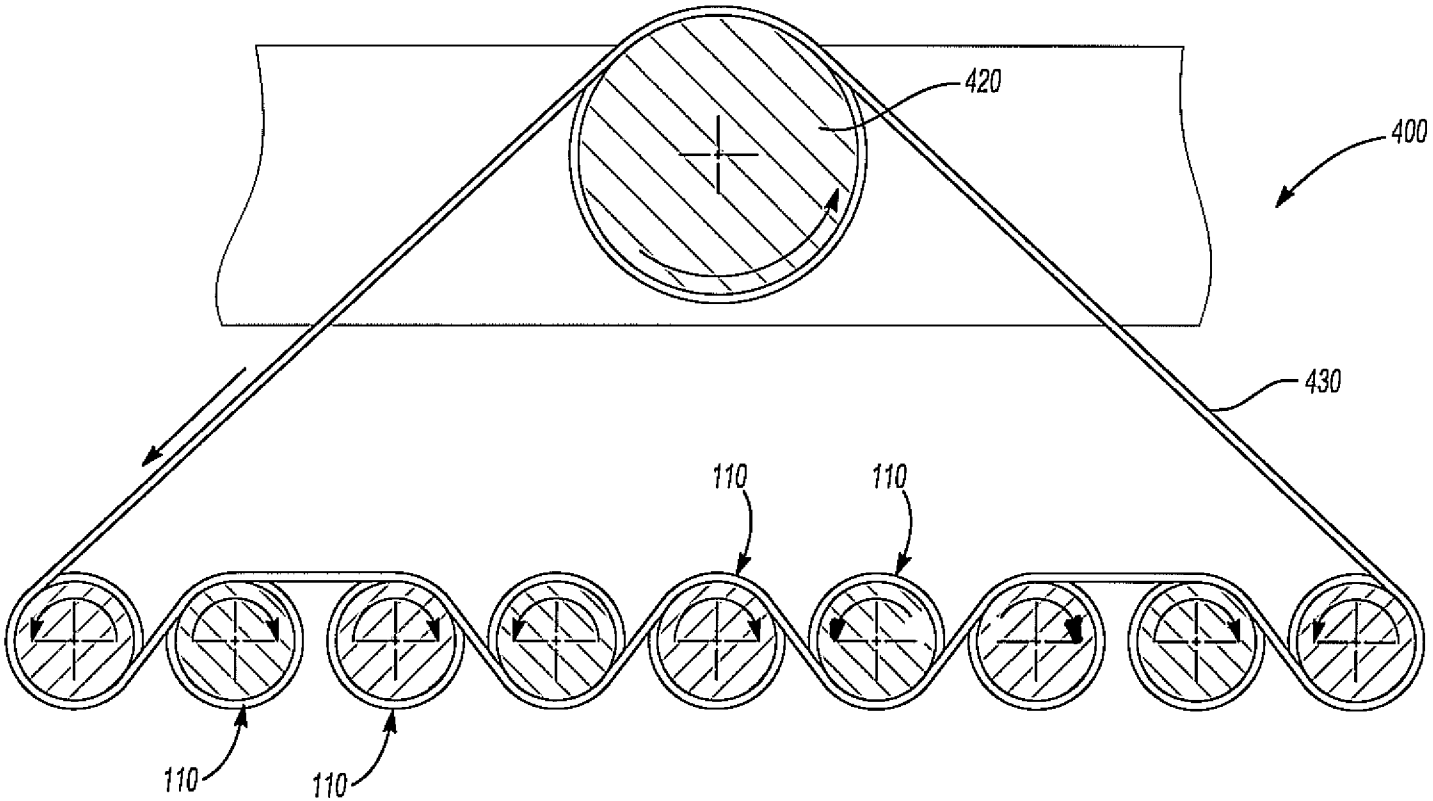
FIG. 3 is an end view of section 3-3 shown in FIG. 1 illustrating an embodiment of a roller drive system.

Turning now to FIG. 3, an example of a drive system for the rollers 110 is shown generally at reference numeral 400. The drive system 400 can include a drive belt 430 that is engaged with the plurality of rollers 110 by being serpentinely routed above and below the rollers 110. In addition, a motor 405 can be used in combination with a drive shaft 410, a pulley 420, and the drive belt 430 such that rotation of the drive shaft 410 results in rotation of the rollers 110. As shown in the figure, a first set of the rollers 110 can rotate in a clockwise direction while a second set of the rollers can rotate in a counterclockwise direction. In the alternative, a linkage can be provided from the motor to the rollers such that each roller rotates in a counterclockwise direction followed by rotation in an opposite counterclockwise direction. As such, it is appreciated that the schematic illustration shown in FIG. 3 is for example purposes only and the drive belt 430 can have different configurations with respect to the rollers 110 and/or other mechanisms can be used to rotate the rollers.

Figure 4:
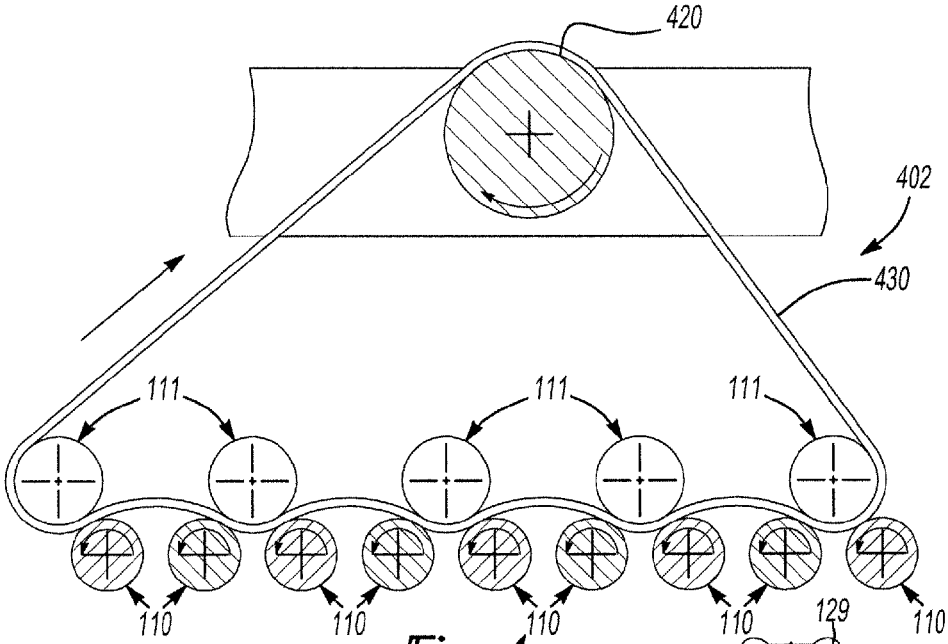
FIG. 4 is an end view of section 3-3 shown in FIG. 1 illustrating another embodiment of a roller drive system.

For example, FIG. 4 illustrates another embodiment of a drive system in which the drive belt 430 passes between a plurality of the rollers 110 and a second set of rollers 111. In this manner, all of the rollers 110 turn in the same direction, counterclockwise in the figure, which can reduce or eliminate jamming of rivets between the rollers 110.

Figure 5:
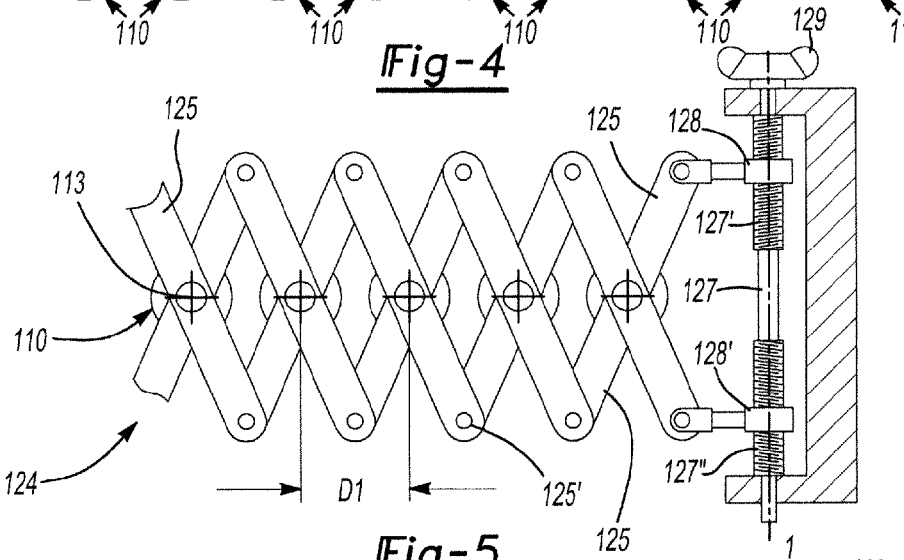
FIG. 5 is an end view of a roller width adjustment mechanism according to an embodiment of the present invention.
Figure 6:
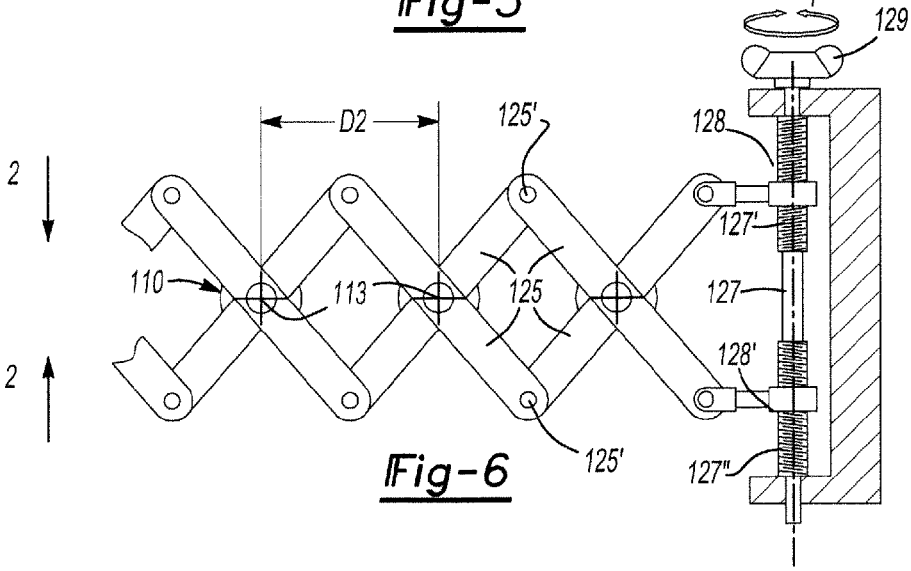
FIG. 6 is an end view of the roller width adjustment mechanism shown in FIG. 5 illustrating an increase in distance between rollers.

In some instances, the gap 116 between the rollers 110 can be adjusted such that a single sorting machine can be used for different sized rivets. One embodiment of such a sorting machine is shown in FIGS. 5 and 6 where the rollers 110 are attached to a scissors linkage 124 that has a plurality of scissor links 125 interconnected with each other about pivot axes 125' as known to those skilled in the art. The rollers 110 can be rotateably attached to the scissor links 125 about pivot axes 113 and an adjustment rod 127 can be attached to two end scissor links 125 as illustrated in the figure. For example, a right hand threaded portion 127' of the adjustment rod 127 can be attached to one of the end scissor links 125 using an attachment point or collar 128 and a left hand threaded portion 127" can be attached another end scissor link 125 using an attachment point or collar 128'. The attachment point 128 and/or 128' can include a threaded nut, washer, ring and the like that affords for the rod 127 to pass therethrough and/or to be attached thereto. In addition, the adjustment rod 127 can be rotateably supported by a brace or frame 126.

Rotation of the rod 127 in a clockwise or counterclockwise direction as illustrated by arrow 1, for example using a knob or handle 129, can bring opposing ends of the two scissor links 125 and/or attachment points 128 and 128' closer together or spread them further apart as illustrated by arrows 2. It is appreciated that the movement of the opposing ends of the two scissor links 125 produces an accordion effect on the scissors linkage 124 and thus moves the attached rollers 110 either further apart or closer together as illustrated by dimensions D1 and D2 in the figures. It is also appreciated that the shafts 122 of the rollers 110 can extend through to the frame 120 using one or more slots (not shown) that afford for the rollers 110 and shafts 122 to move relative to the frame 120 when the gap 116 between the rollers 110 is being adjusted.

Other methods, devices, etc., can also be used to move the rollers 110. For example, a mechanical, hydraulic, electric, and/or pneumatic powered system can be used to rotate the adjustment rod 127 and/or move the scissor links 125. In the alternative, the individual rollers 110 can be moved by hand within a slot (not shown) in the frame 120. As such, FIGS. 5 and 6 only illustrate one embodiment of adjusting the rollers 110 and is not meant to limit the scope thereof.

In operation, and for example and illustrative purposes only, a plurality of rivets containing unused rivets that have a shaft with a head and used rivets that have only a shaft are collected and placed into the hopper 200. The hopper 200 directs the mixture of rivets towards and onto the plurality of rollers 110 which are rotated, for example using the drive system 400. Upon reaching the plurality of rollers 110, the rotation and angled orientation of the rollers 110 affords the rivets to be arranged and aligned such that the shafts of the unused rivets and the used rivets extend between the rollers 110 and through the gaps 116.

The shafts of the used rivets that have no head fall through the gaps 116 and into a bin 300 having a first portion 310 to accept and collect used rivets. However, the heads of the unused rivets do not fit through the gaps 116 and as such cannot fall between the rollers 110. In addition, the angle of the rollers 110, in combination with the rollers 110 being rotated, affords for the unused rivets to move towards the exit end 114. Upon reaching the opening 118, the heads of the unused rivets can fit therethrough and thus fall from the rollers 110, for example into a second region 320 of the bin 300 which is used to collect unused rivets. In this manner, the unused rivets can be conveniently and time efficiently separated from used rivets, not thrown away as waste, and returned to a manufacturing job station.

The various components, parts, and the like of the fastener sorting machine, hopper, bin, and drive system can be made from any material known to those skilled in the art, illustratively including metals, alloys, ceramics, polymers, wood, and the like. In addition, it is understood that various modifications are readily made to the embodiment(s) of the present invention described herein without departing from the scope and spirit thereof. Accordingly, it is understood that the invention is not to be limited by the specific illustrated embodiment(s), but by the scope of the claims.

We claim:

1. A machine for sorting a plurality of fasteners, said machine comprising:

a plurality of normal fasteners each having a shaft and a head, said shaft of the normal fastener having a predetermined diameter, said head of the normal fastener having a predetermined diameter;

at least one defective fastener, said defective fastener only having a shaft, said shaft of the defective fastener having the same predetermined diameter as said normal fastener;

a plurality of rollers rotatably attached to a frame, aligned generally parallel to each other, and oriented at an angle relative to horizontal, the plurality of rollers rotated by a drive belt, the drive belt positioned over at least two adjacent rollers causing the adjacent rollers to rotate in the same direction, the drive belt positioned under an adjacent third roller causing the third roller to rotate in the opposite direction of the at least two adjacent rollers;

said plurality of rollers having a predetermined gap between adjacent rollers, said predetermined gap dimensioned for the shaft of the fastener to fit therethrough and to prevent the head of the fastener to fit therethrough, said predetermined gap larger than the predetermined diameter of the shaft of the defective fastener, said predetermined gap smaller than the predetermined diameter of the head of the normal fastener;

said plurality of rollers having an elevated end and an exit end, said exit end having an opening proximate thereto and dimensioned for the head of the fastener to fit therethrough;

said plurality of rollers operable for sorting the plurality of fasteners by placing the plurality of fasteners onto said plurality of rollers proximate said elevated end, the fasteners moving down to the exit end as said plurality of rollers are rotated with the fasteners having only a shaft falling between the rollers before reaching the exit end, the defective fasteners falling into a first bin, the fasteners having a shaft and a head reaching the exit and falling through the opening into a second bin thereby separating the defective fasteners from the normal fasteners.

2. The machine of claim 1, further comprising a motor engaged with said plurality of rollers, said engaged motor operable to rotate said plurality of rollers in a direction selected from the group consisting of a clockwise direction, a counterclockwise direction and combinations thereof.

3. The machine of claim 1, further comprising a hopper located above the plurality of rollers, said hopper dimensioned for a plurality of fasteners to be placed therewithin and directed to said plurality of rollers.

4. The machine of claim 3, wherein said hopper has at least one divider, said at least one divider operable to divide the plurality of fasteners between the plurality of rollers.

5. The machine of claim 1, further comprising a bin located below said plurality of rollers for collecting fasteners that have fallen through the opening proximate said exit end.

6. A process for sorting fasteners that have a shaft with a head attached thereto from fasteners that have only a shaft, the process comprising:

providing a plurality of rollers rotatably attached to a frame, aligned generally parallel to each other, and oriented at an angle relative to horizontal, the plurality of rollers rotated by a drive belt, the drive belt positioned over at least two adjacent rollers causing the adjacent rollers to rotate in the same direction, the plurality of rollers having a predetermined gap between adjacent rollers, the predetermined gap dimensioned for the shaft of the fastener to fit therethrough and to prevent the head of the fastener to fit therethrough, the plurality of rollers also having an elevated end and an exit end;

providing an opening proximate to the exit end of the plurality of rollers, the opening dimensioned for the shaft and the head of a fastener to fit therethrough;

providing a mixture of fasteners having a shaft and a head, and fasteners that have only a shaft;

placing the mixture of fasteners onto the plurality of rollers proximate the elevated end;

rotating the plurality of rollers, the rotating the plurality of rollers moving the mixture of fasteners along the rollers towards the exit end, rotating the at least two adjacent rollers in the same direction, rotating at least a third adjacent roller in an opposite direction of the at least two adjacent rollers;

the fasteners having only a shaft falling through the gap between the plurality of rollers before reaching the exit end and the fasteners having a shaft and a head falling through the opening proximate the exit end.

7. The process of claim 6, further including providing a motor engaged with the plurality of rollers, the motor rotating the plurality of rollers in a direction selected from the group consisting of a clockwise direction, a counterclockwise direction and combinations thereof.

8. The process of claim 6, further including providing a hopper located above the plurality of rollers and placing the mixture of fasteners into the hopper, the hopper directing the mixture of fasteners onto the plurality of rollers.

9. The process of claim 8, wherein the hopper has at least one divider that divides the mixture of fasteners between the plurality of rollers.

10. The process of claim 6, further including providing a first bin located below the plurality of rollers and collecting the fasteners having only a shaft in the first bin after the fasteners having only a shaft fall through the opening proximate the exit end.

11. The process of claim 6, wherein the fasteners having a shaft and a head are unused rivets, and the fasteners that have only a shaft are used rivets.

12. A process for sorting unused rivets that have a shaft with a head attached thereto from used rivets that have only a shaft, the process comprising:

collecting a plurality of unused rivets and a plurality of used rivets into a mixture of unused and used rivets;

pouring the mixture of unused and used rivets into a hopper, the hopper supplying the unused and used rivets to a rivet sorting machine, the rivet sorting machine having:

a plurality of rollers rotatably attached to a frame, aligned generally parallel to each other, and oriented at an angle relative to horizontal, the plurality of rollers having a gap between adjacent rollers, the gap dimensioned for the shaft of the fastener to fit therethrough and to prevent the head of the fastener to fit therethrough, the plurality of rollers also having an elevated end and an exit end;

an opening proximate to the exit end of the plurality of rollers, the opening dimensioned for the shaft and the head of a rivet to fit therethrough;

rotating the plurality of rollers, the plurality of rollers rotated by a drive belt, the drive belt positioned over at least two adjacent rollers causing the adjacent rollers to rotate in the same direction, the drive belt positioned under an adjacent third roller causing the third roller to rotate in the opposite direction of the at least two adjacent rollers, the rotation of the plurality of rollers resulting in the used rivets falling through the gap between each of the plurality of rollers and the unused rivets moving towards the exit end and falling through the opening;

collecting the used rivets in a first bin and collecting the unused rivets in a second bin.

13. The process of claim 12, further including providing a motor engaged with the plurality of rollers and rotating the plurality of rollers using the motor.

14. The process of claim 13, wherein the motor rotates the plurality of rollers in a direction selected from the group consisting of a clockwise direction, a counterclockwise direction and combinations thereof.

15. The process of claim 13, wherein the motor rotates a first set of the plurality of rollers in a clockwise direction and a second set of the plurality of rollers in a counterclockwise direction.

* * * * *